US005511476A

United States Patent [19]

Banike et al.

[11] Patent Number: 5,511,476

[45] Date of Patent: Apr. 30, 1996

[54] MAGNETIC CYLINDER WITH SURFACE GRIPPING

[75] Inventors: Ronald A. Banike, Belleville, Ill.; Michael Choi, Belleville, Mich.; David G. DeVries, Lisle, Ill.; Andres Peekna, Clarendon Hills, Ill.; Christopher J. Sensmeier, La Grange, Ill.

[73] Assignee: R. R. Donnelley & Sons Co., Chicago, Ill.

[21] Appl. No.: 143,089

[22] Filed: Oct. 26, 1993

[51] Int. Cl.[6] ..... B41F 27/02

[52] U.S. Cl. ..... 101/389.1; 101/375; 101/376; 492/8

[58] Field of Search ..... 101/217, 375, 101/376, 378, 382.1, 383, 384, 389.1, 401.1, 415.1; 492/8, 54, 36

[56] References Cited

U.S. PATENT DOCUMENTS

| | | | |
|---|---|---|---|
| 978,081 | 12/1910 | Wait | 101/415.1 |
| 1,282,922 | 10/1918 | Novotny | 101/415.1 |
| 1,357,341 | 11/1920 | Novotny | 101/378 |
| 1,984,115 | 12/1934 | Cooper | 101/375 |
| 2,038,104 | 4/1936 | Fuller | 101/375 |
| 2,046,504 | 7/1936 | Cooper | 101/375 |
| 2,704,025 | 3/1955 | Anderson et al. | 101/415.1 |
| 3,184,828 | 5/1965 | Dames, Jr. | 492/45 |
| 4,503,769 | 3/1985 | Andersen | 101/401.1 |
| 4,643,095 | 2/1987 | Pfizenmaier et al. | 101/375 |
| 4,676,161 | 6/1987 | Peekna | 101/378 |
| 4,766,811 | 8/1988 | Linska | 101/382.1 |
| 4,817,527 | 4/1989 | Wouch et al. | 101/415.1 |
| 4,864,926 | 9/1989 | Saveressig | 101/378 |

*Primary Examiner*—Christopher A. Bennett
*Assistant Examiner*—Stephen R. Funk
*Attorney, Agent, or Firm*—Wood, Phillips, VanSanten, Clark & Mortimer

[57] ABSTRACT

In accordance with the invention, a magnetic cylinder and image plate or blanket carrier plate of magnetic material are provided for printing. The cylinder has a peripheral surface and the image plate or carrier plate is wrapped around the cylinder with an inner surface of the plate being in direct contact with the cylinder peripheral surface. The blanket and carrier plate are subject to circumferential movement around the cylinder as the blanket is subject to localized pressure from another cylinder in a nip, plus forces due to ink tack. The cylinder peripheral surface is defined by circumferentially spaced, axially extending ridges for suppressing local sliding by surface gripping with the plate inner surface.

26 Claims, 8 Drawing Sheets

A → 2000fpm (10m/s)

B → 2000fpm (10m/s) LOWER LIMT

C → 1200fpm (6m/s)

D → 1200fpm (6m/s) LOWER LIMIT

PREVIOUSLY SMASHED BLANKET SPECIMEN WITH NO UNDERLAY CYLINDER SURFACE FINISH IN CIRCUMFERENTIAL DIRECTION, APPROX. 8-12uin = 0.2-0.3um Ra MAGNETIC ATTRACTIVE FORCE INTENSITY = 47.5psi = 330kPa

× DENOTES TANGENTIAL LOAD EQUALS ZERO POINTS FOR REEVES R16

$R_p = 3.625'' = 92mm$ $R_b = 7.25'' = 184mm$

A → 2000fpm (10m/s)

B → 2000fpm (10m/s) LOWER LIMIT

C → 1200fpm (6m/s)

D → 1200fpm (6m/s) LOWER LIMIT

PREVIOUSLY SMASHED BLANKET SPECIMEN WITH NO UNDERLAY CYLINDER SURFACE FINISH IN CIRCUMFERENTIAL DIRECTION, APPROX. 8-12uin = 0.2-0.3um $R_a$ MAGNETIC ATTRACTIVE FORCE INTENSITY = 47.5psi = 330kPa

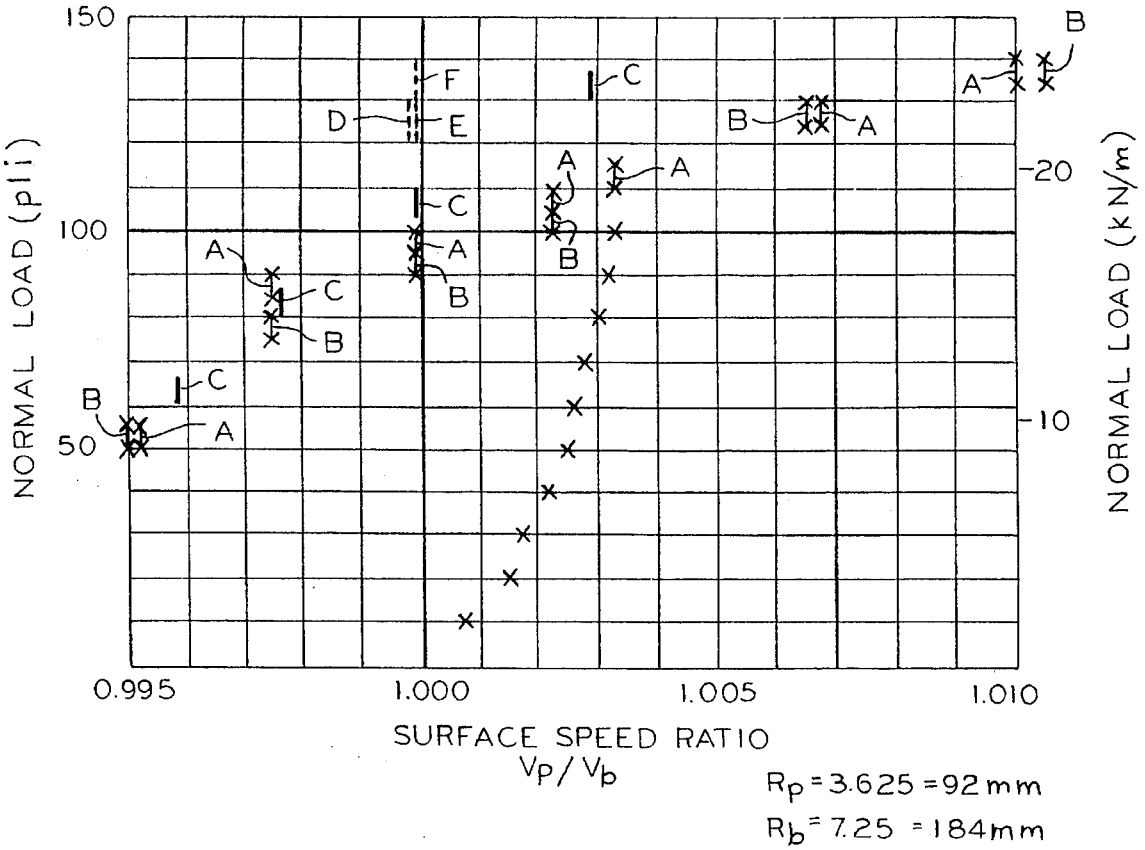

A → 2000 fpm (10 m/s)
B → 1200 fpm (6 m/s)

CHROMIUM PLATED UNDERLAY
SURFACE FINISH IN AXIAL DIR'N,
APPROX. 10 uin = 0.25 um Ra
PREPARED BY SANDING, THEN PLATING
APPROX. 300 uin = 7.5 um OF CHROMIUM
AFTER SIMULATED WEAR OF THE ORDER
OF 10 YEARS
MAGNETIC ATTRACTIVE FORCE
INTENSITY = 6 psi = 41 kPa
CARRIER PLATE THICKNESS 0.027" = 0.69 mm C → 2000 fpm (10 m/s)

AS ABOVE, EXCEPT CARRIER PLATE
THICKNESS 0.010" = 0.25 mm

D → 2000 fpm (10 m/s)
E → 1200 fpm (6 m/s)
F → 600 fpm (3 m/s)

AS ABOVE, EXCEPT CARRIER PLATE
THICKNESS 0.010" = 0.25 mm
SPECIMENS WITH TIGHTER CURVATURE
AT LEADING EDGE; SEE TEXT

X DENOTES TANGENTIAL LOAD EQUALS ZERO POINTS
FOR REEVES R16

FIG. 12

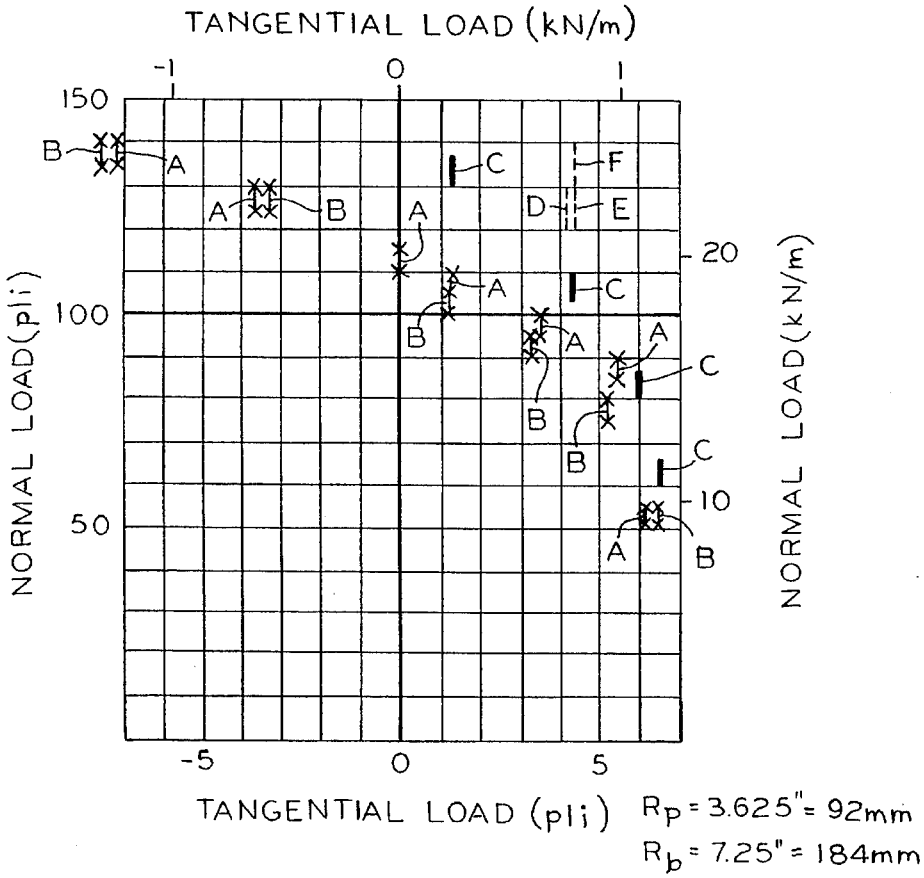

A → 2000fpm (10m/s)

B → 1200fpm (6m/s)

CHROMIUM PLATED UNDERLAY
SURFACE FINISH IN AXIAL DIR'N, APPROX. 10uin = 0.25um $R_a$
PREPARED BY SANDING, THEN PLATING APPROX. 300uin = 7.5um OF CHROMIUM AFTER SIMULATED WEAR OF THE ORDER OF 10 YEARS
MAGNETIC ATTRACTIVE FORCE INTENSITY = 6psi = 41kPa
CARRIER PLATE THICKNESS 0.027" = 0.69mm C → 2000fpm (10m/s)

AS ABOVE, EXCEPT CARRIER PLATE THICKNESS 0.010" = 0.25mm

D → 2000fpm (10m/s)

E → 1200fpm (6m/s)

F → 600fpm (3m/s)

AS ABOVE, EXCEPT CARRIER PLATE THICKNESS 0.010" = 0.25mm
SPECIMENS WITH TIGHTER CURVATURE AT LEADING EDGE; SEE TEXT

FIG. 13

MAGNETIC CYLINDER WITH SURFACE GRIPPING

FIELD OF THE INVENTION

This invention relates to a magnetic cylinder for supporting a plate and/or blanket in a printing press.

BACKGROUND OF THE INVENTION

In rotary offset printing, a web offset press applies ink to an image plate mounted on a plate cylinder. The image plate transfers ink to a resilient blanket on a blanket cylinder. The blanket imprints a paper web with the ink. The plate and blanket cylinders have to hold the image plate or blanket on the associated cylinder surface. Cylinders have been used which hold the plate magnetically. Magnetic cylinders must have sufficient holding capability for reliable operation in rotary web offset printing.

As discussed in Peekna et at., U.S. Pat. No. 4,676,161, owned by the assignee hereof, a typical blanket for a magnetic cylinder includes a carrier plate of ferromagnetic material. A blanket sheet is bonded to an outer surface of the carrier plate. A magnetic cylinder comprises a cylindrical core with peripheral axially spaced permanent magnets. Adjacent magnets have opposite polarity. Pole pieces of magnetic material are provided between adjacent magnets. The permanent magnets, pole pieces and the plate form magnetic circuits in which the flux established by the permanent magnets substantially saturate the peripheral faces of the pole pieces and annular sections of the plate between adjacent pole pieces.

As described in the Peekna et al. patent, the magnetic circuits were optimized to resist peeling the image plate or blanket carder plate off the cylinder. Additionally, the magnetic circuits were designed to suppress circumferential blanket movement.

Particularly, slow circumferential movement of a blanket on a magnetic cylinder has been observed under some printing conditions. Including also the results of laboratory investigations, several features of the slow circumferential movement have emerged, as follows. With a bare steel image plate on a magnetic cylinder rolling against a blanket on the other cylinder, movement is in the same direction as a tangential force on the plate in the nip. The tendency of a bare steel plate to move on a magnetic cylinder is enhanced by decreasing the normal nip load. With a blanket laminated to a steel carrier plate on a magnetic cylinder, movement is always opposite the direction of rotation irrespective of the direction of the tangential force in the nip. The tendency of a blanket laminated to a steel plate to move on a magnetic cylinder is enhanced by increasing the normal nip load. Introducing a layer of oil between a blanket carrier plate and a magnetic cylinder had a suppressing effect on movement. The behavior of a bare plate is accounted for by a sliding phenomenon. More particularly, by a sliding wave, in which sliding takes place only over a small area at or adjacent to the nip, with the plate acquiring a residual compressive strain to one side of the sliding wave, and residual tensile strain on the other side. The behavior of a blanket is hypothesized to be related to a lifting wave phenomenon in a small area adjacent to the nip. The carrier plate length along the lifting wave is slightly longer than the cylinder surface under the lifting wave. Accordingly, the blanket and carrier plate move along with the nip a small distance with each cylinder revolution. Movement with the nip along the cylinder is opposite the direction of rotation. Thus, a lifting wave always moves opposite the direction of rotation, no matter what the cause or provocation. Introducing a layer of oil or other partial seal impedes the flow of air into the space underneath an incipient lifting wave, thereby tending to inhibit its initiation.

The present invention is intended to overcome one or more of the problems discussed above.

SUMMARY OF THE INVENTION

It is an object of the invention to provide a printing cylinder which minimizes circumferential movement of a plate supported thereon.

In accordance with the invention, a magnetic cylinder and plate of magnetic material are provided for printing. The cylinder has a peripheral surface and the plate is wrapped around the cylinder with an inner surface of the plate being in direct contact with the cylinder peripheral surface. The plate is subject to circumferential movement around the cylinder as the plate is subject to localized pressure from another cylinder in a nip, plus forces due to ink tack. At least one of the cylinder peripheral surface and the plate inner surface are defined by means for suppressing local sliding by surface gripping with the other of the surfaces.

It is a feature of the invention that the one surface includes a plurality of circumferentially spaced, axially extending ridges.

In one aspect of the invention, the ridges are provided on the cylinder peripheral surface.

It is a feature of the invention that the cylinder surface is of a greater hardness than the plate. More particularly, the cylinder surface has a yield strength at least approximately three times an ultimate strength of the plate.

It is another feature of the invention that the cylinder peripheral surface is plated with chromium.

It is still another feature of the invention that the plate includes a series of indentations received from the ridges because of nip pressure, the indentations having to climb up sides of the ridges before circumferential movement can occur.

Further features and advantages of the invention will readily be apparent from the drawings and the specification.

BRIEF DESCRIPTION OF THE DRAWINGS

FIG. 12 comprises a curve showing test results for blanket movement thresholds for a blanket with surface gripping according to the invention expressed in terms of normal nip load at different surface speed ratios; and FIG. 13 comprises a curve for a test similar to that in FIG. 12 showing blanket movement thresholds expressed in terms of normal load and tangential load.

DETAILED DESCRIPTION OF THE INVENTION

Figure 1:
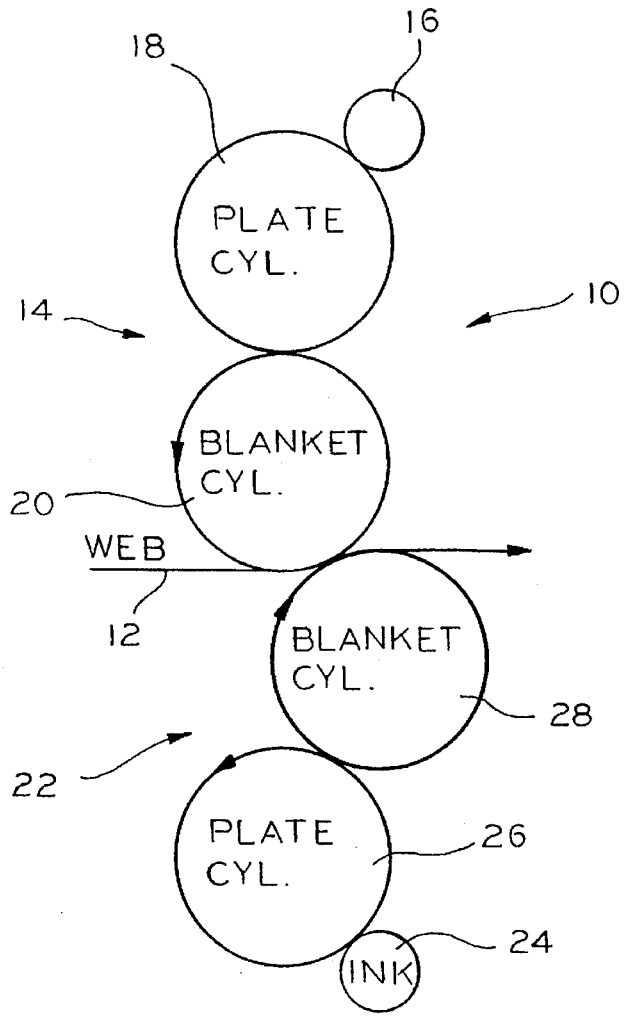
FIG. 1 is a diagram illustrating the physical arrangement of cylinders in a web offset printing press.

With reference to FIG. 1, a rotary offset press 10 for printing on two sides of a web 12 is illustrated schematically. The press 10 includes an upper set 14 of cylinders and a lower set 22 of cylinders, each generally identical in operation. Particularly, the upper set 14 comprises an ink cylinder 16, a plate cylinder 18, and a blanket cylinder 20. The lower set 22 includes an ink cylinder 24, a plate cylinder 26 and a blanket cylinder 28. The web passes between the blanket cylinders 20 and 28.

In a printing operation, ink is applied via the respective ink cylinders 16 and 24 to the plate cylinders 18 and 26. Each plate cylinder 18 and 26 supports an image plate (not shown) including a preformed image thereon representing areas for which ink is to be applied to the web 12. The ink is transferred from the image plate on each plate cylinder 18 and 26 to a resilient blanket on each respective associated blanket cylinder 20 and 28. The paper web 12 is then printed on the top with ink on the blanket cylinder 20 and on the bottom with ink on the blanket cylinder 28.

Figure 2:
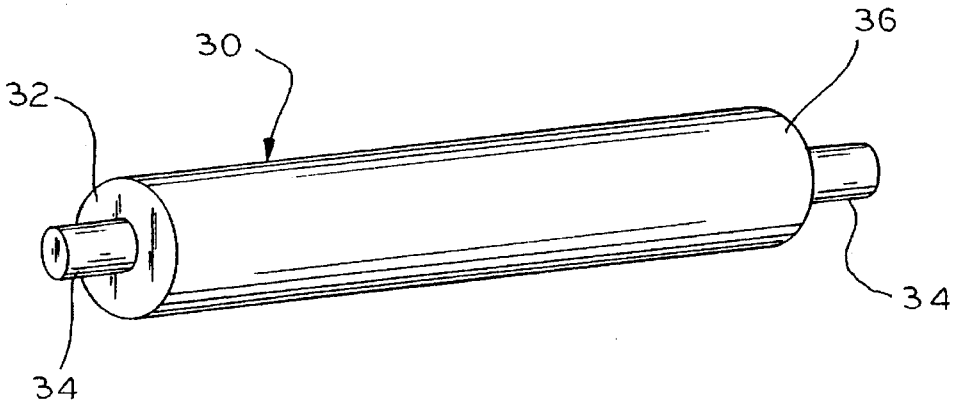
FIG. 2 is a perspective view of a typical cylinder for the press of FIG. 1.

With reference to FIG. 2, a printing cylinder 30 has a cylindrical body 32 with stub shafts 34 extending from each end. The cylindrical body may be as shown in Peekna et at., U.S. Pat. No. 4,676,161. The cylinder includes a peripheral cylinder surface 36 having means for providing surface gripping in accordance with the invention, as described below.

The cylinder 30 shown in FIG. 2 may comprise any one of the plate cylinders 18 and 26 or blanket cylinders 20 and 28 illustrated in FIG. 1 in which an associated plate is wrapped around the cylinder with an inner surface of the plate being in direct contact with the cylinder peripheral surface 36.

Figure 3:
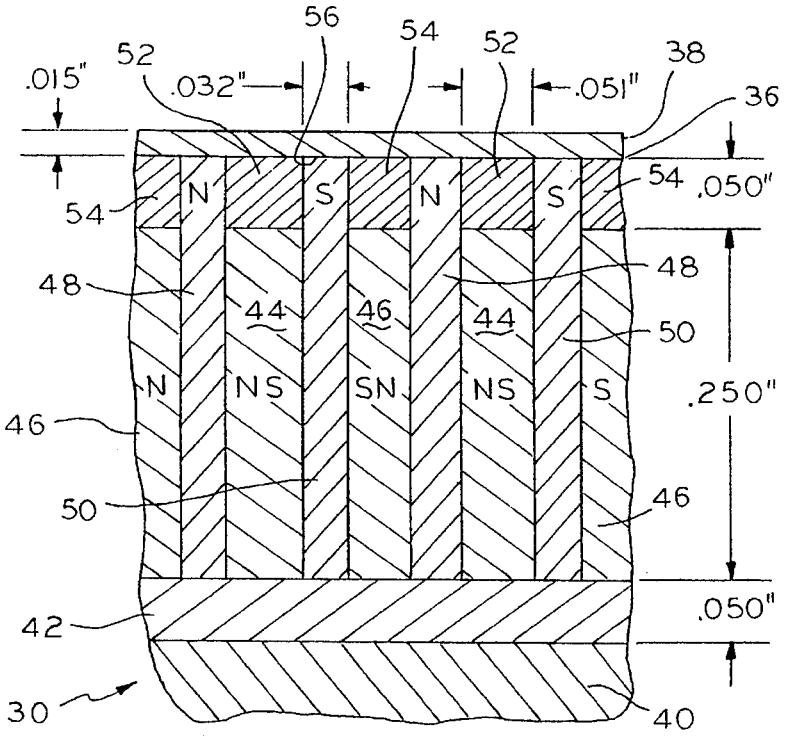
FIG. 3 is an enlarged fragmentary section of the magnetic structure and plate of the cylinder of FIG. 2 shown supporting an image plate.

With reference to FIG. 3, the cylinder 30 is shown supporting an image plate 38. The cylinder 30 includes a cylindrical shaft 40, which may be of steel, having a sleeve 42 of a non-magnetic material thereon to isolate the magnetic structure from the body. Typically, the sleeve 42 is of brass. Surrounding the sleeve 42 are a plurality of annular magnets 44 and 46 separated by pole pieces 48 and 50. Annular spacers 52 and 54 overlie the respective magnets 44 and 46. The cylinder peripheral surface 36 is defined by the outer surface of the pole pieces 48 and 50 and spacers 52 and 54. As described above, an inner surface 56 of the image plate 38 is supported on the cylinder peripheral surface 36.

Figure 4:
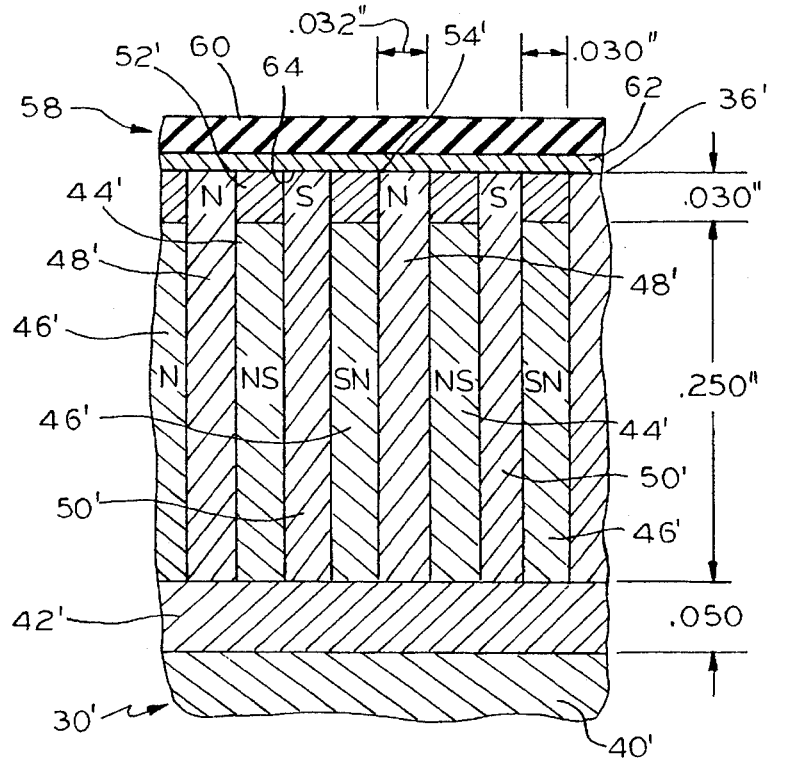
FIG. 4 is an enlarged fragmentary section of the magnetic structure and plate of the cylinder of FIG. 2 shown supporting a blanket sheet and carrier plate.

An offset printing blanket is a resilient sheet, generally a composite material of elastomer and fabric reinforcing. In order to mount the blanket on a magnet cylinder, a magnetic material must be incorporated in the blanket. With reference to FIG. 4, a printing blanket 58 includes a blanket sheet 60 bonded to a ferromagnetic stainless steel carrier plate 62. The blanket 58 is mounted to a cylinder 30'. In the cylinder 30', the elements are identified by the same reference numerals as in FIG. 3, with prime indications. As above, the blanket cylinder peripheral surface 36' supports an inner surface 64 of the blanket carder plate 62.

As discussed above, a blanket sheet bonded to a steel carrier plate has been observed to undergo gradual circumferential movement around a magnetic cylinder during web printing. It is suspected that this movement occurs as a result of local separation of the blanket carrier plate from the cylinder adjacent to a nip, as the plate-blanket nip. This local separation is illustrated as a wave-like action in FIG. 5, where the blanket 58 is carried on the magnetic blanket cylinder 20 which rotates in a counterclockwise direction. The plate cylinder 18 with which a nip is formed at 64 rotates in a clockwise direction. The plate length ABD is slightly longer than the cylinder surface length ACD. Accordingly, the blanket 58 moves in a direction opposite the direction of rotation a slight distance on each cylinder revolution.

Figure 6:
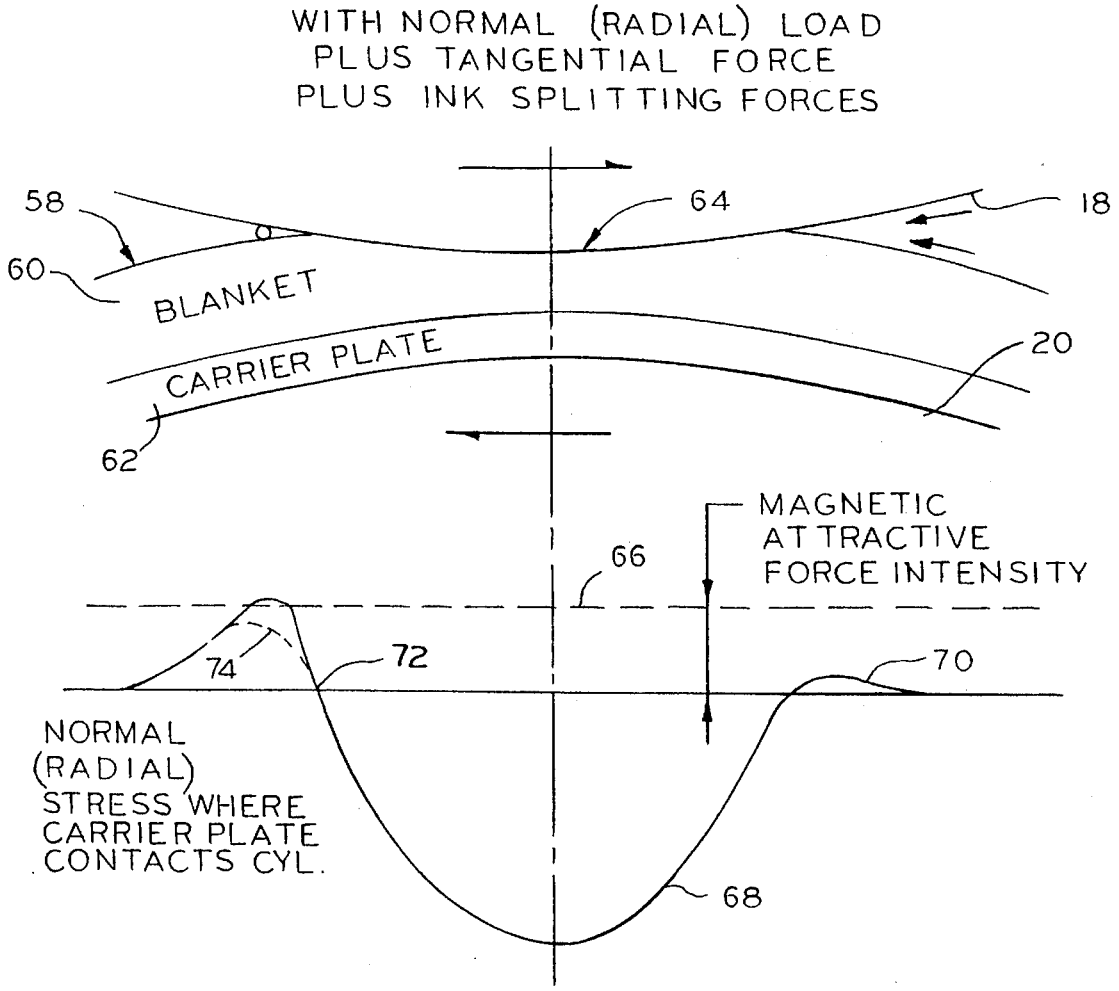
FIG. 6 is a diagram illustrating the forces acting on the blanket of FIG. 6 adjacent the nip.

Referring also to FIG. 6, there is illustrated at the top the cross-section of the plate-blanket nip 64 and at the bottom a plot of forces about the nip. The curve illustrates a dashed line 66 showing the magnetic attractive force intensity of the cylinder 20. This force must be overcome in order for any lifting of the blanket 58 to occur. As can be seen, the substantial nip load in the radial direction from the image cylinder 18 provides a compressive force as at 68.

Figure 5:
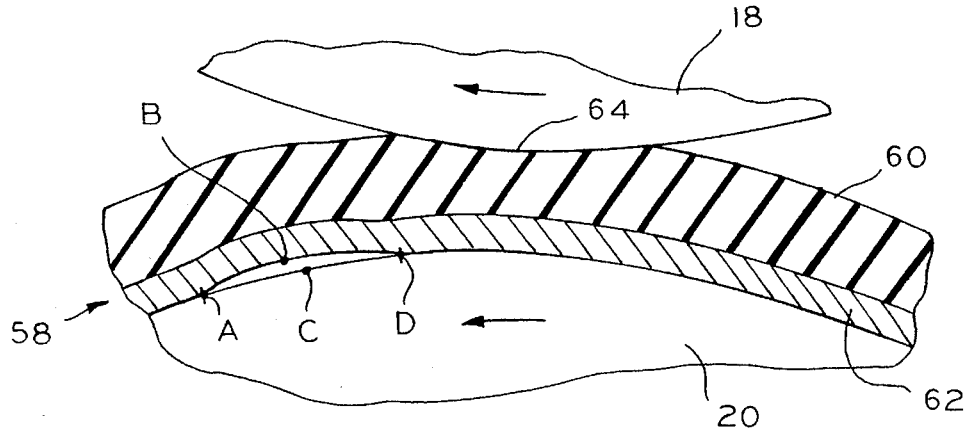
FIG. 5 is a diagram illustrating the blanket and carder plate in a nip showing the lifting wave which, it is believed, causes circumferential displacement of the blanket on the cylinder.

One of the effects of the compressive load 68 in the area of the nip is to produce tensile stresses of lower magnitude just before the nip, as at 70, and just after the nip, as at 72. However, there are also tangential forces. In a typical web offset press, under most conditions the direction of the tangential force on the blanket surface is opposite to the direction of blanket cylinder rotation, in the paper nip as well as in the plate-blanket nip. The tangential forces on the blanket surface are concentrated in the downstream end of the nip. The combined effect of the radial stresses and tangential stresses exerted on the blanket surface on the radial stresses at the carrier plate and cylinder interface downstream of the nip are illustrated in dashed line at 74. The effects of normal and tangential nip loads are contact-mechanical effects. There are also ink-tack effects. The addition of the ink-tack effect is illustrated in the curved portion 72 above the dashed line 74. When the forces due to ink splitting at the downstream end of the nip are added to the contact-mechanical effects, then it can be seen that these forces may exceed the magnetic attractive force intensity, resulting in a tendency to form a lifting wave, as shown in FIG. 5.

One method for minimizing lift-off and thus suppressing circumferential movement is to increase the magnetic attractive force intensity. This factor is discussed in Peekna et al., U.S. Pat. No. 4,676,161. In accordance with the invention, a surface gripping effect is added to the cylinder. The surface gripping is provided by sanding the cylinder surface 36 in an axial direction to provide axial ridges, as discussed below.

Figure 7:
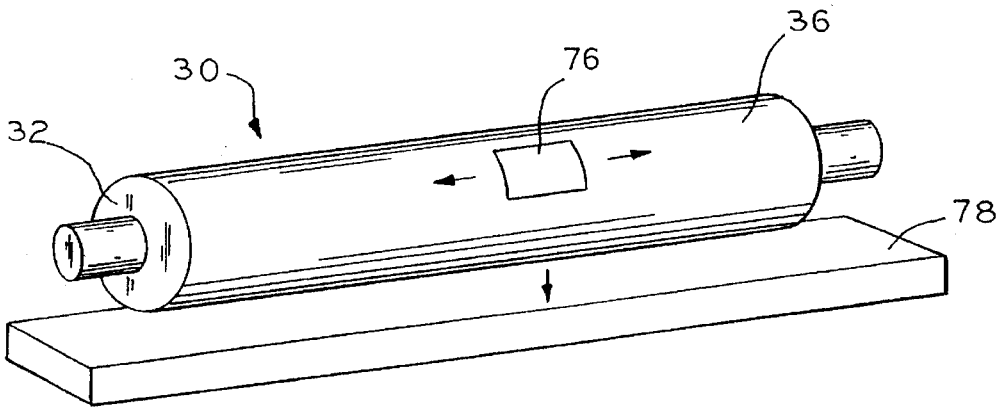
FIG. 7 is a perspective diagram illustrating a method of providing surface gripping on the cylinder of FIG. 2.

With reference to FIG. 7, a method is illustrated for providing surface gripping. Prior to sanding, the cylinder surface 36 comprises a relatively smooth surface. The surface 36 is sanded using, for example, an emery cloth 76 sanding in an axial direction. The sanding can be done by hand. Alternatively, a hand-held belt sander or the like, or a more automated system may be used. The sanding may be done by any appropriate sanding apparatus and is not intended to be limited to use of an emery cloth. The sanding in the axial direction has been tested using both a 3M "fine" emery cloth and a 3M "coarse" emery cloth. In testing, the higher parts of the higher ridges on axially sanded cylinder surfaces make shallow indentations in the carrier plates. Indentations occur because the ridges are work-hardened from the thorough sanding, while the carrier plate surface is closer to a fully annealed condition. Movement by means of a lifting wave causes repeated indentations of the carrier plate by the ridges.

In order to minimize wear, it is desirable to provide a greater hardness difference between the ridged cylinder surface and the carrier plate. According to the theory of plasticity, in order for an indenter of material A in the shape of a two-dimensional ridge with a relatively obtuse top not to be deformed while indenting into a softer material B, the yield strength of material A has to be nearly three times the ultimate strength of material B. (See, for example, W. Prager and P. G. Hodge, Jr., *Theory of Perfectly Plastic Solids*, New York, Wiley, 1951.) For hard metals, the yield strength is usually not much lower than the ultimate strength, so the ratio of ultimate strengths, or of hardness on scales that are roughly proportional to ultimate strength, such as diamond pyramid hardness and knoop hardness, may also be used. To increase hardness, the cylinder peripheral surface 36 may be plated with chromium after sanding in the axial direction. Such a cylinder has been tested with 300 microinches (0.0075 mm) of chromium plated over the sanded surface. The plating process may be the same as for gravure design cylinders in which the cylinder is preheated with approximately 160°–180° F. hot water spray for twenty minutes. The cylinder is then plated as by dipping the cylinder 30 in a bath 78, see FIG. 7, of Unichrome HCR-312/100 compound, from M & T Chemicals, Inc., or the like, with a bath temperature of 125° F. During plating the cylinder 30 is rotated continuously, approximately five revolutions per minute. After plating, the cylinder is cooled in ambient air.

The findings on the effects of surface finish, and especially the effectiveness of axial ridges indenting into a smooth, softer material, suggest that surface gripping is involved, perhaps in helping suppress initiation of the lifting wave. The combination of lifting stresses adjacent to the nip, compressive stresses in the nip itself, and shear stresses in and especially at the downstream end of the nip, as discussed above relative to FIGS. 5 and 6, create shear stresses as well as normal stresses on the carder plate inner surface. Relieving the shear stresses by local sliding would make it easier to form a lifting wave. By suppressing local sliding even in those regions where the normal compressive stresses are small or nearly zero, surface gripping can also help prevent a lifting wave from taking place. This surface gripping effect is different from friction between smooth surfaces.

Figure 8A:
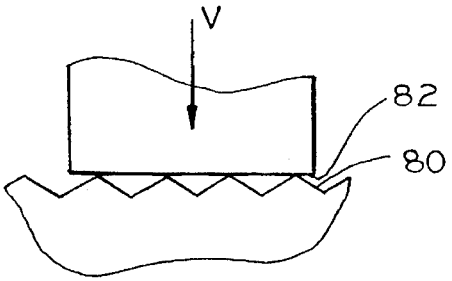
FIGS. 8A and 8B comprise enlarged fragmentary sections of a plate on the cylinder of FIG. 2 viewed in an axial direction showing indentations on the plate under normal loads.
Figure 8B:
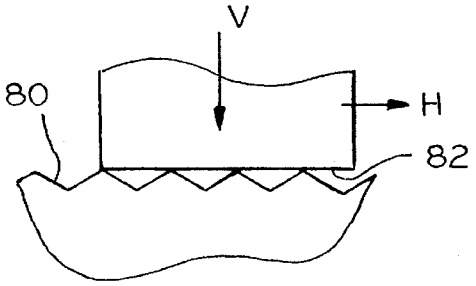
Figure 9A:
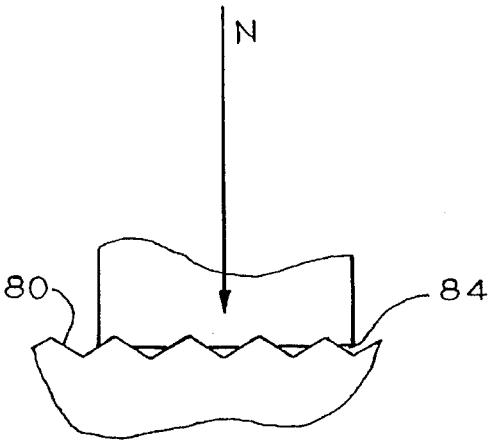
FIGS. 9A and 9B comprise enlarged fragmentary sections of a plate on the cylinder of FIG. 2 viewed in an axial direction showing indentations on the plate under larger normal loads.
Figure 9B:
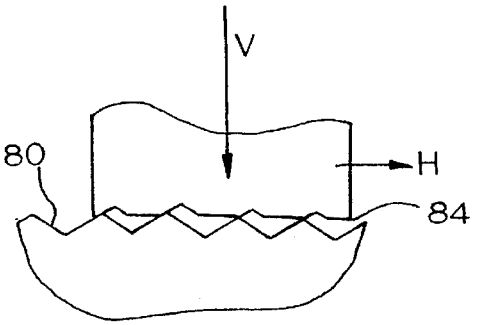

One feature in the functioning of axial ridges or similar gripping configurations in suppressing blanket movement is that the maximum compressive stress at the center of the nip applies a much greater load on the indenting ridges than is the case adjacent to the nip where the lifting wave is formed, and where the normal or radial stress is basically the magnetic attractive force intensity, minus lifting stresses at the point in question. Thus, in this particular application, the axial ridges function somewhat differently than would be the case when a ridged or knurled roller would be used to increase traction in conveying sheet materials. The difference is illustrated in comparing FIGS. 8A and 8B to FIGS. 9A and 9B. In FIGS. 8A and 8B, resistance to lateral motion is due to simultaneous application of a normal load V, without prior history of larger normal loads. Particularly, FIG. 8A illustrates indents 82 formed from circumferentially spaced axial ridges 80 by a normal load V. FIG. 8B illustrates movement in response to a lateral force H, resulting in lateral enlargement of the indents 82 by means of plastic flow. By contrast, in FIGS. 9A and 9B there is a prior history of indentation 84 formed by a larger normal load N. Particularly, FIG. 9A illustrates the indents 84 formed by a large normal load N. FIG. 9B illustrates the threshold of movement in response to a lateral force H in the presence of a normal force V much smaller than the force N in FIG. 9A. Before subsequent lateral motion can take place when a much smaller load V is applied, the indented member has to climb up the sides of the ridges 80, as shown in FIG. 9B.

To understand how a series of indentations can increase resistance to lateral motion, as in FIG. 9B, one may consider a simplified model in which all ridges make the same angle θ with respect to the horizontal in FIG. 9B. The problem may be analyzed relative to a block being pulled by a horizontal force up a plane inclined at an angle θ. Force balance gives the following expression for the ratio H/V, where f is the coefficient of friction for smooth surfaces.

$$\frac{H}{V} = \frac{\sin\theta + f\cos\theta}{\cos\theta - f\sin\theta}$$

Representative values of the coefficients of static friction of chromium on steel and steel on steel are given by Weiner and Walmsley as 0.17 and 0.30, respectively (*Chromium Plating*; Finishing Publications, Ltd., Teddington, Middlesex, England, 1980; p. 38). Values of H/V for these respective values of the coefficient of friction for smooth surfaces are given in the following table.

Values of the Ratio of Lateral Load H to Normal Load V with Indentations From a Ridge Array

| | H/V for | | | | |
|---|---|---|---|---|---|
| Coefficient of Friction For Smooth Surfaces | θ = 5° | θ = 10° | θ = 20° | θ = 30° | θ = 45° |
| 0.17 | 0.261 | 0.357 | 0.569 | 0.829 | 1.410 |
| 0.30 | 0.398 | 0.503 | 0.745 | 1.061 | 1.857 |

These values demonstrate that the angle of incline does not have to be very great (that is, the ridge-tops can be quite obtuse) for H/V to increase significantly over the respective coefficients of friction for smooth surfaces. They also show that the smooth-surface coefficient of friction has a smaller effect on surfaces with ridge-indentations running perpendicular to the direction of lateral forces than on smooth surfaces without such ridges.

An additional possible mechanism further increasing the effectiveness of axial ridges arises from their enhancing a partial vacuum effect tending to suppress lifting wave initiation. Keeping in mind that the lifting wave dimensions are much smaller in the circumferential than in the axial direction, the circumferential finish grooves in prior art cylinders tend to let air into the space under an incipient lifting wave near a plate or blanket carrier plate leading edge. Indeed, comparison of blanket movement threshold test results obtained with a smooth, shiny mill finish stainless steel underlay surface with a partially smoothed cylinder surface which still contained circumferential finish grooves from the original grinding suggested that circumferential finish grooves tend to increase the tendency to move. This is also consistent with the observation that the partial sealing effect of introducing a layer of oil had a suppressing effect on blanket movement. Axial ridges tend to function analogously to knife-edge seals, tending to keep air out.

The effectiveness of surface gripping using axial ridges is demonstrated in the following tests. The tests consisted of determining circumferential movement threshold data. The tests were conducted on a rotary blanket test stand which allowed for measurement of tangential as well as normal nip loads. In the test stand, a solid aluminum cylinder is run against a magnetic cylinder with a blanket laminated to a carrier plate. The axial width of the cylinders was designed for four inch wide blanket specimens. The stand was designed to accommodate cylinders of 7.25 inches and 14.5 inch diameter, with all testing done with the solid aluminum cylinder, used as the plate cylinder, approximately 7.25 inches diameter, while the outer diameter of the blanket cylinder was approximately 14.5 inches. To control tangential loads, the test stand was set such that both cylinders were driven.

In the results, each bar plotted indicates both lower limit, at the highest load tested which showed no movement, and upper limit, at the lowest load tested under otherwise the same conditions that showed movement. Exceptions, with the lower limits only, are shown as upward-pointing arrows in movement threshold plots; the lower limit is at the lower end of the arrow.

Figure 10:
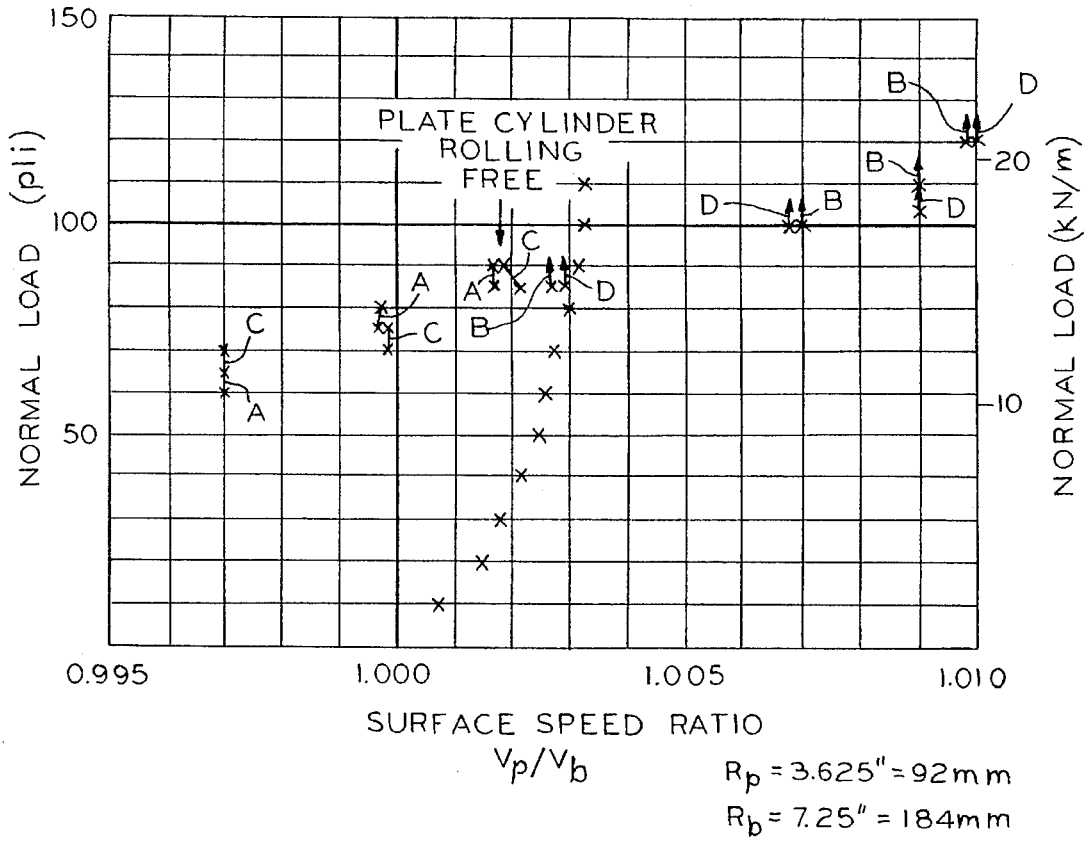
FIG. 10 comprises a curve showing test results for blanket movement thresholds for a cylinder without surface gripping expressed in terms of normal nip load at different surface speed ratios.
Figure 11:
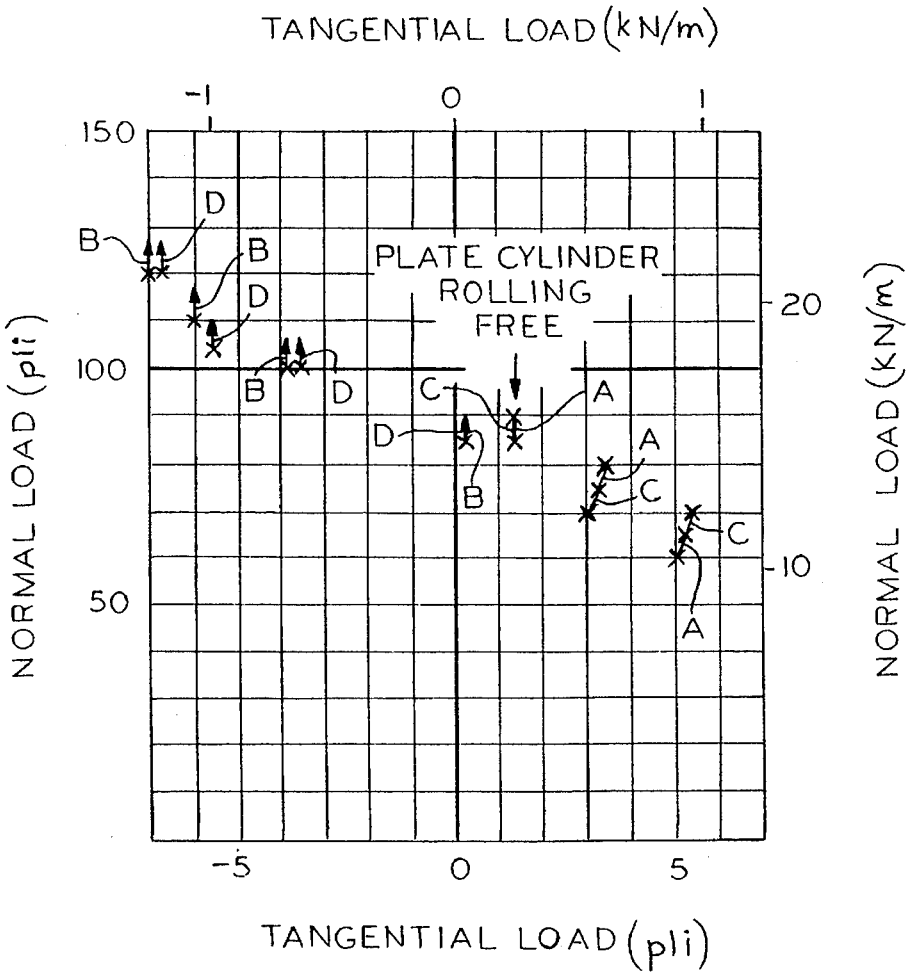
FIG. 11 comprises a curve for a test similar to that in FIG. 10 showing blanket movement thresholds expressed in terms of normal load and tangential load.

FIG. 10 illustrates blanket movement thresholds expressed in terms of normal nip load at different surface speed ratios at a magnetic attractive force intensity of 47.5 psi and the cylinder surface provided without surface gripping axial ridges. The tests were conducted with a Reeves R16 blanket with data shown for four test parameters, labeled A, B, C and D. FIG. 11 illustrates blanket movement thresholds expressed in terms of normal load and tangential load.

In testing the cylinder including surface gripping as by axial sanding, the results over a range of tangential as well as normal loads with the Reeves R16 blanket are shown in FIGS. 12 and 13. In these tests the magnetic attractive force intensity was only 6 psi. The lower force intensity was achieved by means of underlays on the cylinder surface. The outermost underlay surface was prepared by sanding AISI 430 stainless steel sheet material, which is the same alloy as in the cylinder pole pieces 48 and 50 in FIG. 3 and 48' and 50' in FIG. 4. This was then plated in a bath as discussed above, using another magnetic cylinder as a mandrel. This was done because such a low attractive force intensity had to be used in order to find any movement in the nip load ranges of interest.

After producing gripping underlay surfaces, as discussed above and relative to FIG. 7, surface profilometry tests were conducted. The results are illustrated in the following table:

Some Surface Profilometry Results on AISI 430 Stainless Steel Surfaces Prepared by Sanding, then Plating With Approximately 300 Microinches (0.075 mm) of Chromium.

| Quantity | Prepared with 3M "Fine" Emery | Prepared with 3M "Coarse" Emery |
|---|---|---|
| Average Roughness $R_a$ | 9.3 μin.<br>0.24 μm | 16.5 μin.<br>0.42 μm |
| Maximum Leveling Depth $R_p$ | 57 μin.<br>1.45 μm | 98 μin.<br>2.5 μm |

The average roughness $P_a$ is the arithmetic mean of the roughness profile about its center line. The maximum leveling depth $R_p$ is the vertical distance from the highest peak in a measuring length to the center line of the roughness profile. The values in the above table are from measurements after wear simulation. Results obtained on other pieces prepared the same way but not subjected to wear simulations were similar.

The wear simulations were designed to simulate wear of the axial ridges under printing operational conditions, such as due to blanket changes, cleaning the cylinder of ink residue, etc. Specifically, the wear simulations were designed to simulate ten years' service printing with black ink, following by ten years' service printing with cyan process color ink. Black and cyan inks are known to cause more wear than the other process color inks. The movement threshold tests of FIGS. 12 and 13 were done after these wear simulations were completed.

The tests were done with two carrier plate thicknesses; one 0.027 inches, and the other 0.010 inches. The higher average thresholds with the thin carrier plate at the same magnetic attractive force intensity may be due to thin carder plates having better tolerance of curvature mismatch with the cylinder, which arises from lower flexural stiffness.

As is apparent, the thresholds in FIGS. 12 and 13 are higher throughout when compared to the thresholds in FIGS. 10 and 11, even though the magnetic attractive force intensity has been lowered from 47.5 psi to only 6 psi.

As an alternative, sanding in the axial direction can be applied directly to a cylinder after plating. While sanding of a chromium plated surface is much more difficult, due to the greater hardness, a suitable finish can be obtained. Advantageously, the surface gripping is provided by using some type of mechanically controlled sanding mechanism, as opposed to hand sanding. The gripping effect has been found to be better than without axial sanding, but not as good as with the surfaces that were first sanded and then chromium plated. This difference suggests that the microscopic crystalline surface structure of as plated chromium plays a role in surface gripping.

Hard surfaces other than chromium may also be used. The hardest of electroless nickel platings barely makes it above Rockwell C 58, in the as-plated (not heat-treated) condition; chromium is significantly harder. Some composite coatings of metal matrix embedded with hard materials, such as electroless nickel with silicon carbide, may work reasonably well.

Building on the magnetic cylinder methods and design disclosed in Peekna et at., U.S. Pat. No. 4,676,161, the method described here provides an economical and very effective way to boost the safety factor on slow blanket movement by taking advantage of surface gripping phenomenon and suppressing the movement wave after and adjacent to the nip. This is accomplished after assembling and grinding a blanket cylinder in the usual way. A surface finish with grooves and ridges running in the axial direction is imparted by sanding. Initially, for small quantities, hand sanding with 3M "coarse" emery cloth suffices, though for mass production, appropriate tooling for accomplishing the same purpose could be designed. The 3M "coarse" emery cloth was found to give about the same finish on a magnetic cylinder as the 3M "fine" on an annealed sheet of ASI 430 stainless steel. The cylinder is then plated with approximately 300 μin. of chromium, as discussed above. A 300 μin. non-magnetic layer and a blanket cylinder with barium ferrite magnets decreases peel-off resistance by thirteen percent. With a 0.018 inch thick carrier plate, the peel-off resistance decreases from 6.8 pli to 5.9 pli. While not amounting to a serious decrease in the safety factor on blanket peel-off, the decrease can be made up by increasing the carrier plate thickness by twenty percent to 0.022 inches.

Thus, in accordance with the invention, significant increase in the safety factor on slow blanket movement by means of surface gripping is provided. The surface gripping is accomplished by using ridges extending in the axial direction on the cylinder surface.

We claim:

1. In a magnetic cylinder and plate of magnetic material for printing, in which the cylinder has a peripheral surface and the plate is wrapped around the cylinder with an inner surface of the plate being in direct contact with the cylinder peripheral surface, the plate being subject to circumferential movement around the cylinder as the plate is subject to localized pressure, with or without additional forces due to ink tack, from another cylinder in a nip, the improvement comprising, at least one of the cylinder peripheral surface and the plate inner surface being defined by means for suppressing local sliding by surface gripping with the other of said surfaces, the one said surface including a plurality of circumferentially spaced, generally axially extending ridges forming indentations in the other said surface.

2. The improvement of claim 1 wherein the ridges are provided on the cylinder peripheral surface.

3. The improvement of claim 2 wherein the plate includes a series of indentations received from the ridges, the indications having to climb up sides of the ridges before circumferential movement can occur.

4. The improvement of claim 2 wherein the cylinder peripheral surface has an average roughness of at least approximately 9 microinches, the average roughness being defined as an arithmetic mean of a roughness profile about a centerline of the roughness profile.

5. The improvement of claim 2 wherein the cylinder peripheral surface has a maximum leveling depth of at least approximately 55 microinches, the maximum leveling depth being defined as a vertical distance from the highest peak in a measuring length to a centerline of a roughness profile.

6. In a magnetic cylinder and plate of magnetic material for printing, in which the cylinder has a peripheral surface and the plate is wrapped around the cylinder with an inner surface of the plate being in direct contact with the cylinder peripheral surface, the plate being subject to circumferential movement around the cylinder as the plate is subject to localized pressure, with or without additional forces due to ink tack, from another cylinder in a nip, the improvement comprising, at least one of the cylinder peripheral surface and the plate inner surface being defined by means for suppressing local sliding by surface gripping with the other of said surfaces wherein the one said surface includes a plurality of circumferentially spaced, generally axially extending ridges and is of a greater hardness than the other said surface.

7. In a magnetic cylinder and plate of magnetic material for printing, in which the cylinder has a peripheral surface and the plate is wrapped around the cylinder with an inner surface of the plate being in direct contact with the cylinder peripheral surface, the plate being subject to circumferential movement around the cylinder as the plate is subject to localized pressure, with or without additional forces due to ink tack, from another cylinder in a nip, the improvement comprising, at least one of the cylinder peripheral surface and the plate inner surface being defined by means for suppressing local sliding by surface gripping with the other of said surfaces, wherein the cylinder peripheral surface includes a plurality of circumferentially spaced, generally axially extending ridges and wherein said cylinder peripheral surface is plated with a hardening material.

8. The improvement of claim 7 wherein the hardening material is chromium.

9. In a magnetic cylinder and plate of magnetic material for printing, in which the cylinder has a peripheral surface and the plate is wrapped around the cylinder with an inner surface of the plate being in direct contact with the cylinder peripheral surface, the plate being subject to circumferential movement around the cylinder as the plate is subject to localized pressure, with or without additional forces due to ink tack, from another cylinder in a nip, the improvement comprising, at least one of the cylinder peripheral surface and the plate inner surface being defined by means for suppressing local sliding by surface gripping with the other of said surfaces, wherein the cylinder peripheral surface includes a plurality of circumferentially spaced, generally axially extending ridges and the cylinder surface is of a greater hardness than the plate.

10. Then improvement of claim 9 wherein the cylinder surface has a yield strength at least approximately three times an ultimate strength of the plate.

11. In a magnetic cylinder and a resilient blanket bonded to a carrier plate of magnetic material for offset web printing, in which the cylinder has a peripheral surface and the plate is wrapped around the cylinder with an inner surface of the plate being in direct contact with the cylinder peripheral surface, the carrier plate and blanket being subject to circumferential movement around the cylinder as the blanket is subject to localized pressure, with or without additional forces due to ink tack, from another cylinder in a nip, the improvement comprising;

the cylinder peripheral surface being defined by means for suppressing lifting waves by surface gripping of the plate inner surface.

wherein the cylinder surface includes a plurality of circumferentially spaced, generally axially extending ridges.

12. The improvement of claim 11 wherein the cylinder surface is of a greater hardness than the plate.

13. The improvement of claim 11 wherein said cylinder peripheral surface is plated with a hardening material.

14. The improvement of claim 11 wherein said cylinder peripheral surface is plated with chromium.

15. The improvement of claim 11 wherein the cylinder peripheral surface has a yield strength at least approximately three times an ultimate strength of the plate.

16. The improvement of claim 11 wherein the plate includes a series of indentation received from the ridges, the indentations having to climb up sides of the ridges before circumferential movement can occur.

17. The improvement of claim 11 wherein the cylinder peripheral surface has an average roughness of at least approximately 9 microinches, the average roughness being defined as an arithmetic mean of a roughness profile about a centerline of the roughness profile.

18. The improvement of claim 11 wherein the cylinder peripheral surface has a maximum leveling depth of at least approximately 55 microinches, the maximum leveling depth being defined as a vertical distance from a highest peak in a measuring length to a centerline of a roughness profile.

19. The method of assembling a magnetic cylinder and resilient blanket sheet bonded to a carrier plate of magnetic for offset web printing, comprising the steps of:

providing the magnetic cylinder including a peripheral surface having a plurality of circumferential spaced, generally axially extending ridges, and wrapping the carrier plate and blanket sheet around the cylinder with an inner surface of the carrier plate being in direct contact with the cylinder peripheral surface, the cylinder peripheral surface suppressing lifting waves by surface gripping of the carrier plate inner surface.

20. The method of claim 19 wherein the providing step comprises sanding the cylinder surface in an axial direction to provide the axial ridges.

21. The method of claim 20 wherein the providing step comprises plating the cylinder surface with chromium.

22. The method of claim 20 wherein the cylinder peripheral surface is sanded to have an average roughness of at least approximately 9 microinches, the average roughness being defined as an arithmetic mean of a roughness profile about a centerline of the roughness profile.

23. The method of claim 20 wherein the cylinder peripheral surface is sanded to have a maximum leveling depth of at least approximately 55 microinches, the maximum leveling depth being defined as a vertical distance from a highest peak in a measuring length to a centerline of a roughness profile.

24. The method of claim 19 wherein the providing step comprises selecting the cylinder surface to have a greater hardness than the plate.

25. The method of claim 19 wherein as a result of wrapping the plate and blanket around the cylinder and the blanket being subject to cylinder forces the plate includes a series of indentations receiving the ridges, the indentations having a climb up sides of the ridges before circumferential movement can occur.

26. In a magnetic cylinder and resilient blanket bonded to a carrier plate of magnetic material for offset web printing, in which the cylinder has a peripheral surface and the plate is wrapped around the cylinder with an inner surface of the plate being in direct contact with the cylinder peripheral surface, the carrier plate and blanket being subject to circumferential movement around the cylinder as the blanket is subject to localized pressure, with or without additional forces due to ink tack, from another cylinder in a nip, the improvement comprising, the cylinder peripheral surface being defined by means for enhancing a vacuum effect to suppress lifting wave initiation, wherein the cylinder surface includes a plurality of circumferentially spaced, generally axially extending ridges.

* * * * *